United States Patent [19]

Krajicek et al.

[11] 4,398,604

[45] Aug. 16, 1983

[54] METHOD AND APPARATUS FOR PRODUCING A HIGH PRESSURE THERMAL VAPOR STREAM

[75] Inventors: Richard W. Krajicek; John S. Sperry, both of Houston, Tex.

[73] Assignee: Carmel Energy, Inc., Houston, Tex.

[21] Appl. No.: 253,320

[22] Filed: Apr. 13, 1981

[51] Int. Cl.[3] ..... E21B 36/00; E21B 43/24; E21B 47/06

[52] U.S. Cl. ..... 166/303; 166/53; 166/57; 166/64; 166/79; 166/250

[58] Field of Search ..... 166/57, 53, 64, 302, 166/303, 272, 250; 60/39.05, 39.57, 39.58, 39.59

[56] References Cited

U.S. PATENT DOCUMENTS

| | | | |
|---|---|---|---|
| 525,271 | 8/1894 | Langen | 60/39.59 |
| 940,769 | 11/1909 | Wilstam | 60/39.58 X |
| 956,465 | 4/1910 | Wright | 60/39.59 |
| 2,734,578 | 2/1956 | Walter | 166/59 |
| 2,754,098 | 7/1956 | Heinze | 262/3 |
| 2,793,497 | 5/1957 | Walter | 60/39.55 |
| 2,823,752 | 2/1958 | Walter | 166/11 |
| 2,839,141 | 6/1958 | Walter | 166/261 |
| 2,916,877 | 12/1959 | Walter | 60/39.55 |
| 3,353,360 | 11/1967 | Gorzegno | 60/39.58 X |
| 3,620,571 | 11/1971 | Billings | 299/6 |
| 3,785,146 | 1/1974 | Bailey | 60/39.05 X |
| 3,948,323 | 4/1976 | Sperry et al. | 166/303 |
| 3,980,137 | 9/1976 | Gray | 166/303 |
| 3,993,135 | 11/1976 | Sperry et al. | 166/303 |
| 4,118,925 | 10/1978 | Sperry et al. | 60/39.05 |
| 4,156,421 | 5/1979 | Cradeur et al. | 60/39.57 X |
| 4,244,684 | 1/1981 | Sperry et al. | 60/39.05 X |

FOREIGN PATENT DOCUMENTS

| | | | |
|---|---|---|---|
| 105472 | 2/1971 | Mexico | 60/39.57 |
| 106801 | 3/1972 | Mexico . | |

*Primary Examiner*—Stephen J. Novosad
*Assistant Examiner*—George A. Suchfield
*Attorney, Agent, or Firm*—Pravel, Gambrell, Hewitt, Kirk & Kimball

[57] ABSTRACT

A method and apparatus for producing a high pressure thermal vapor stream of water vapor and combustion gases for recovering heavy viscous petroleum from a subterranean formation, wherein the method includes directing high pressure combustion gases into a partially water-filled vapor generator vessel for producing therein a high pressure stream of water vapor and combustion gases, and thereafter injecting high quality steam into the high pressure stream of water vapor and combustion gases within the vapor generator vessel to increase the steam-to-combustion gas ratio of the discharge stream produced within the vapor generator vessel, and thereafter flowing the discharge stream into a subterranean formation for enhanced recovery of viscous petroleum therefrom.

24 Claims, 3 Drawing Figures

METHOD AND APPARATUS FOR PRODUCING A HIGH PRESSURE THERMAL VAPOR STREAM

TECHNICAL FIELD

This invention relates generally to the recovery of petroleum from a subterranean formation and more particularly pertains to a new and improved method and apparatus for producing a high pressure thermal vapor stream for injection into the subterranean formation for recovering heavy viscous petroleum therefrom.

PRIOR ART

Apparatus for the successful recovery of mineral using a high pressure thermal vapor stream typically involve the production of hot combustion gases for flow into a steam generating device for producing sufficiently high quantities of a high pressure thermal vapor of steam and combustion gases which thereafter is injected into a subsurface formation for the economical recovery of highly viscous petroleum therefrom. Examples of such apparatus are described in the following U.S. Pat. Nos., to name a few: 4,156,421; 4,118,925; 3,980,137; 3,620,571; 2,916,877; 2,839,141; 2,793,497; 2,823,752; 2,734,578; 2,754,098; and Mexican Pat. Nos. 105,472 and 106,801. Additionally, various methods for using such apparatus are known in the prior art and include processes such as those disclosed in U.S. Pat. Nos. 3,993,135 and 3,948,323.

It is well known that in order to provide economical recovery of liquifiable minerals such as viscous petroleum, large volumes of thermal fluid must be generated and injected into the formation. This is particularly true in techniques for the recovery of viscous petroleum wherein the thermal fluid is usually continuously produced and injected into a petroleum-bearing formation over a period of from several hours to several days and even months. Additionally, in such techniques for the recovery of petroleum, the thermal fluid must be injected into the subterranean formation under pressures higher than formation pressure. Additionally, certain very viscous hydrocarbon deposits need large amounts of heat applied thereto to reduce the viscosity to make possible recovery. Because of the very large amounts of heat that must be generated and required, difficulties arise in protecting equipment utilized in producing the vapor stream as well as having a suitable system for providing sufficiently high volumes of steam and combustion gases under sufficiently high pressure to provide satisfactory economic recovery of the viscous petroleum products. Since there are large quantities of hithertofore unproducible crude petroleum, this invention becomes very important in times when available fossil fuels are needed.

SUMMARY OF THE INVENTION

This invention relates to a new and improved method and apparatus for producing a high pressure thermal vapor stream of water vapor and combustion gases for recovering heavy viscous petroleum from subterranean formations. The method of the present invention comprises directing high pressure combustion gases into a partially water-filled vapor generator for producing therein a high pressure stream of water vapor and combustion gases. High quality steam is injected into the vapor generator vessel for increasing the steam to combustion gas ratio of the discharge stream produced within the vapor generator vessel, and thereafter flowing the high pressure discharge stream from the vapor generator vessel into the subterranean formation for enhanced recovery of the heavy, viscous petroleum from the subterranean formation.

DESCRIPTION OF THE PREFERRED EMBODIMENT

While the method and apparatus of the present invention may be employed for the recovery of substantially any type of crude from substantially any type of subterranean petroleum-bearing formation, it is particularly useful for economically and efficiently recoverying heavy viscous crudes having API gravities of below about 22° and viscosities greater than about 150 centipoise (at 60° Fahrenheit). The inventive process and apparatus is especially useful for recovering these highly viscous crudes from formations which have such low relative permeabilities to water and oil that they will not accept direct steam injection at pressures below formation fracture gradient pressures at high formation injection rates. Such formations usually have an absolute permeability to air averaging within the range of from about fifty to about 2000 MD; however, the relative permeabilities to water and oil may be less than one percent of the absolute permeability. These low relative permeability viscous crude-bearing formations are well known to those having ordinary skill in the art of thermal recovery.

Figures 2, 3:
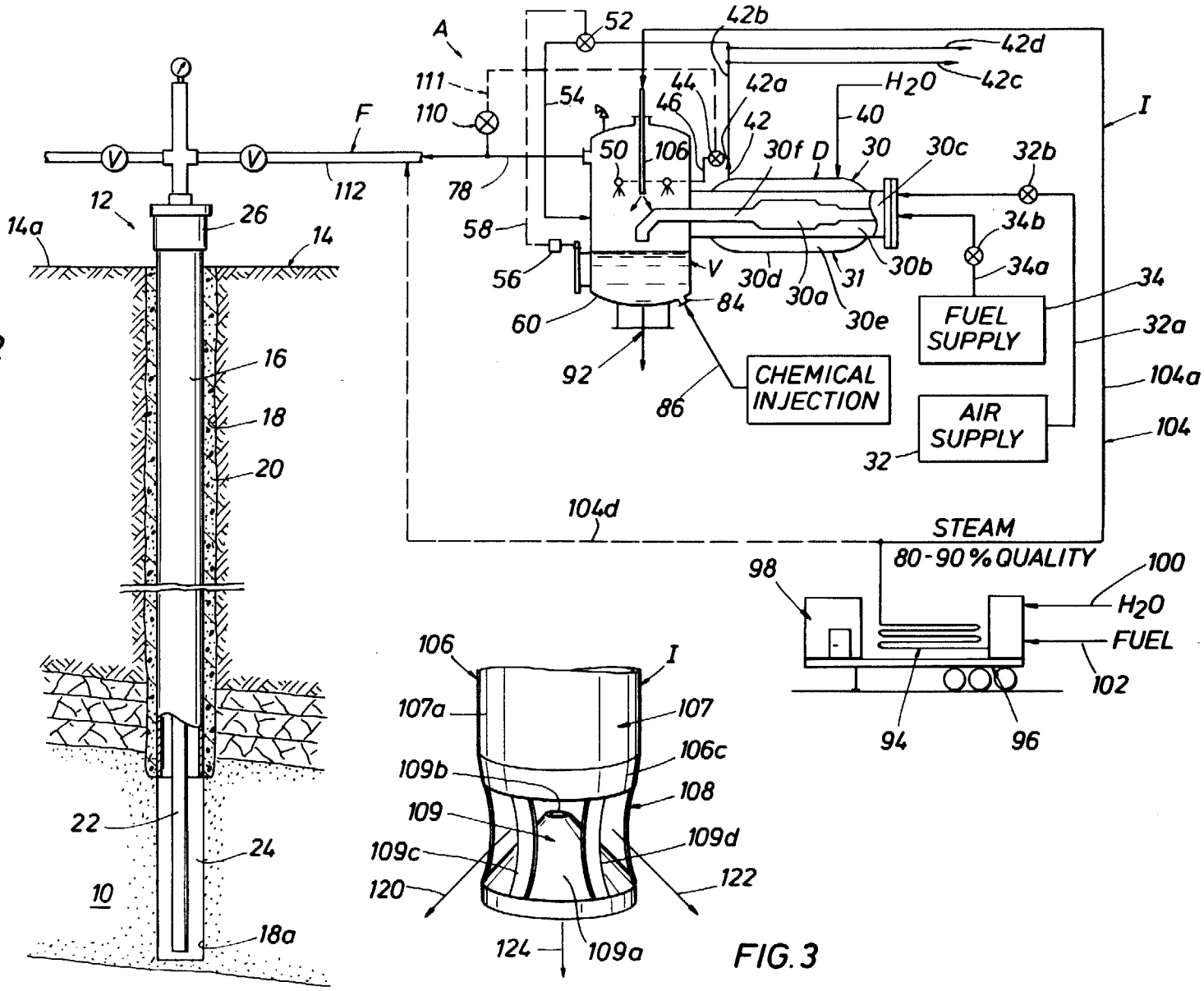
FIG. 2 is a schematic drawing, partially in crosssection, illustrating a well penetrating a petroleum-bearing formation and the method and apparatus for producing a high pressure thermal vapor stream of water vapor and combustion gases for recovering heavy viscous petroleum from such a subterranean formation, in accordance with the teachings of the present invention; and, FIG. 3 is a perspective view of the steam injector of the present invention.

In the drawings, the letter A designates generally the apparatus for producing high pressure thermal vapor stream of water vapor and combustion gases for recovering heavy viscous petroleum from a subterranean formation 10. The apparatus A generally includes a vapor generator vessel V, directing means D, injection means I, and flowing means F, all for recovering heavy viscous petroleum from such a subterranean formation 10. As shown in FIG. 2, the producing formation 10 bearing heavy viscous petroleum is penetrated by a well, shown generally at 12, which has been drilled from the surface 14*a* of the earth 14. The well 12 has preferably been completed in a conventional manner and includes a string of casing 16 set within a bore hole 18 to the top of the petroleum bearing formation 10 and supported by a cement sheath 20. The bore hole 18 preferably has penetrated the petroleum bearing formation and has been drilled near to the bottom of the desired formation injection zone. The bore hole 18 may be left open as in an open hole completion or a screen slotted liner or other perforated device (not shown) may be set in the lower end 18*a* of the bore hole 18 to support the walls of the bore hole 18.

The well 12 also includes a string of tubing 22 disposed within the casing 16 and the bore hole 18 extending through the formation 10 thereby forming an annulus 24 therebetween. Preferably, the tubing string 22 extends downwardly to near the lower end 18*a* of the bore hole 18. A conventional sealing device (not shown) is provided adjacent the top of the well head 26 to seal off the annulus 24 and maintain pressure within the well. Generally, the apparatus A is connected with the well head 26 by means of a flowing means F, as discussed below, for providing a high pressure thermal vapor stream of water vapor and combustion gases for recovering the heavy viscous petroleum from the subterranean formation 10.

The apparatus A of the present invention preferably includes a vapor generator vessel V, directing means D, injecting means L, and flowing means F. The directing means D is for directing high pressure combustion gases into the vapor generator vessel V for producing a high pressure stream of water vapor and combustion gases in the vapor generator vessel V. The directing means D includes a high pressure combustion chamber designated generally as 30. The high pressure combustion chamber 30 is adapted to produce high pressure combustion gases and may be of the type disclosed in U.S. Pat. No. 4,118,925. Generally speaking, however, the high pressure combustion chamber 30 includes a combustion chamber 30*a* formed within a refractory material liner 30*b* that may be of a ceramic composition that is housed within a combustion housing 30*c*, with a water jacket 30*d* formed about the combustion housing 30*c*. As partially seen in FIG. 1, an annular water chamber 30*e* is formed about the combustion housing 30*c* between the exterior surface of the combustion housing 30*c* and the interior surface of the water jacket 30*d* for receiving a cooling fluid such as water or the like therein for cooling the combustion chamber 30 and for preheating the water, as discussed more fully hereinbelow.

Generally speaking, the combustion chamber 30*a* receives high pressure air from air supply 32 which flows through supply line 32*a* to the high pressure combustion chamber 30, along with fuel from fuel supply 34 which flows through supply line 34*a* to high pressure combustion chamber 30 for mixing within the combustion chamber 30*a*. Suitable valving means such as valves 32*b*, 34*b* permit regulation of the air supply and fuel supply, respectively, to ensure a proper air/fuel mixture within the high pressure combustion chamber 30 to ensure proper combustion therein. The high pressure combustion gases from the combustion chamber 30*a* flow from the combustion chamber 30*a* through exhaust outlet 30*f*. The exhaust outlet 30*f* extends into the vapor generator vessel V explained in more detail hereinbelow by means of neck portion 30*g*. The neck portion 30*g* has a suitable flange 30*h* formed therewith. An elbow 36 is affixed to the neck portion 30*g* of the high pressure combustion chamber 30 adjacent flange 30*h* by compatibly formed flange 36*a*, with a suitable fastening means 38 extending therebetween flanges 30*h*, 36*a* for removably joining the elbow 36 with the high pressure combustion chamber 30. Alternatively, a slip-on type flange may be used for flange 36*a*. The elbow 36 preferably includes a horizontal portion 36*b* adapted to be aligned with the neck portion 30*g*, an angled portion 36*c* in communication with horizontal portion 36*b*, and a vertical portion 36*d* in communication with angled portion 36*c* which may alternatively be a long radius ninety degree elbow. Preferably, a continuous discharge chamber 36*e* is formed within the elbow 36 extending from the horizontal portion 36*b* through the vertical portion 36*d*, with the high pressure combustion gases exiting from the high pressure combustion chamber 30 from exhaust outlet 30*f* being directed outwardly therefrom and thereinto the elbow 36, with the high pressure combustion gases being thereafter directed outwardly from the vertical portion 36*d* of the elbow 36, in a downwardly direction as viewed in FIG. 1, into the vapor generator vessel V.

The water jacket 30*d* is provided to protect the combustion housing 30*c* from structural failure due to excessive heating. The water chamber 30*e* is adapted to receive a stream of cooling water from a flowline 40 (FIG. 2) which is circulated within the water chamber 30*e* for heat exchange with the combustion housing 30*c*. An outlet flowline 42 directs water heated within the water chamber 30*e* outwardly therefrom. As such the water jacket 30*d*, water chamber 30*e* form the preheating means 31 of the present invention for preheating the water to be used in the vapor generator vessel V and for cooling the high pressure combustion chamber 30.

The outlet flowline 42 splits into four fluid flow streams through flowlines 42*a*, 42*b*, 42*c*, 42*d*. The preheated fluid or water flowing through flowline 42*a* is directed through control valve 44 thereinto flowline 46 (FIGS. 1, 2) which is in fluid communication with manifold 48, having suitable nozzles 50 mounted therewith. Each nozzle 50 has suitable orifices 50*a* for directing the preheated water into the vapor generator vessel V. The manifold 48 and nozzles 50 are secured with the vapor generator vessel V, with the nozzles 50 communicating with the manifold 48 for receiving preheated water therefrom. Fluid or water flowing in flowline 42*b* communicates with a suitable control valve 52, which regulates the fluid flow in flowline 54. A fluid level controller 56, as is well known in the art, is mounted with the vapor generator vessel V for controlling the fluid or water level therein, as discussed more fully hereinbelow. The controller 56 actuates the control valve 52 by means of control line conduit 58. Thus, flowlines 46, 54 are adapted to receive preheated water from the water chamber 30*e* for introduction within the vapor generator vessel V. Further, as shown schematically in FIG. 2, fluid or water flowing in flowlines 42*c*, 42*d* flow to the combustion burner head of the combustion chamber 30 and to the water storage tank as a return line, respectively.

Figure 1:
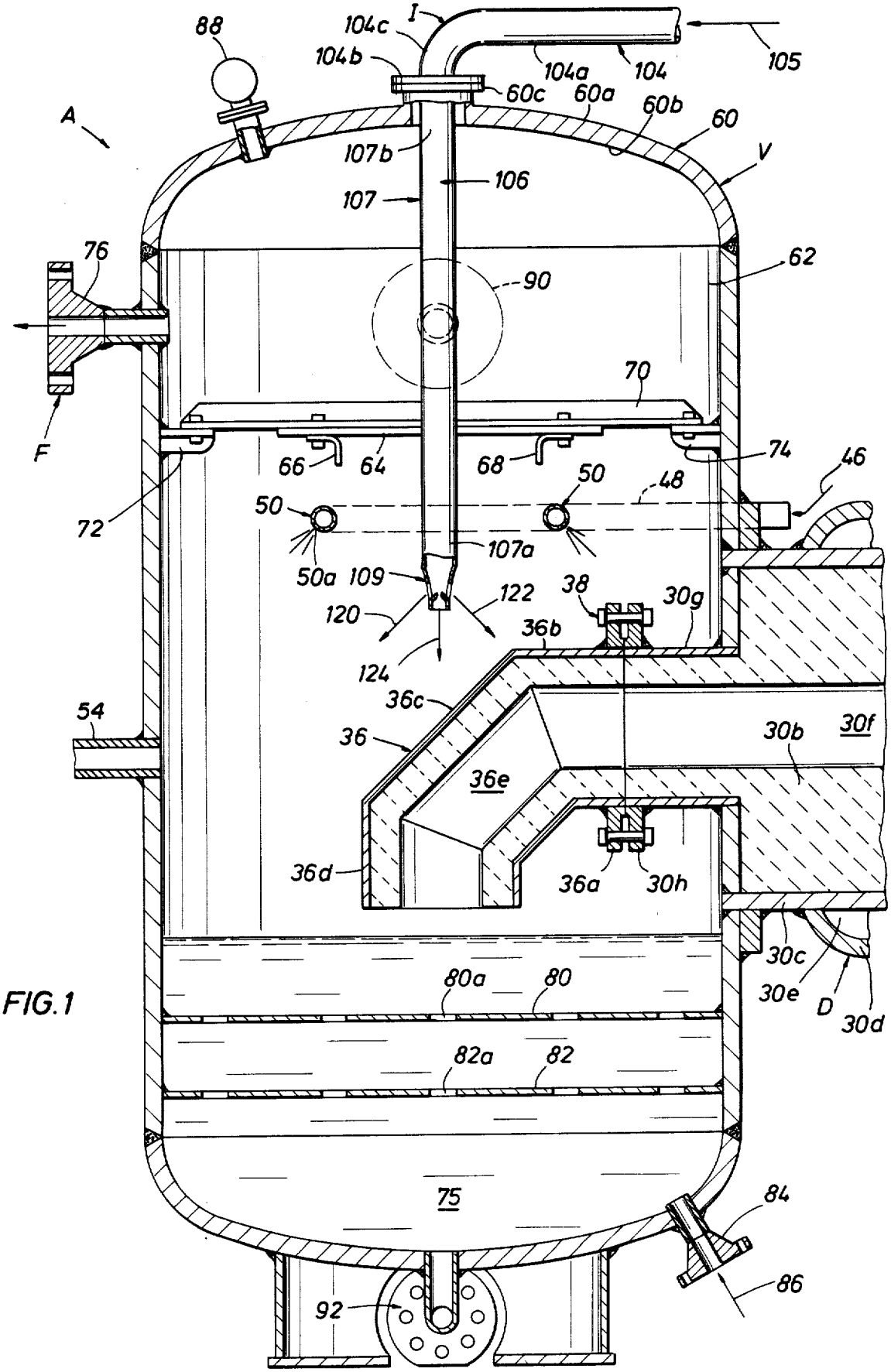
FIG. 1 is an elevational, sectional view of the vapor generator vessel of the preferred embodiment of this invention.

As best seen in FIG. 1, the vapor generator vessel V of the present invention includes a vessel 60 formed having an outer surface 60*a* and an inner surface 60*b*. The inner surface 60*b* defines a vapor chamber, designated generally as 62. Preferably, as discussed hereinabove, the neck portion 30*g* of the high pressure combustion chamber 30 is mounted with the vessel 60, extending thereinto the vapor chamber 62, having the elbow 36 affixed thereto. In similar fashion, the manifold 48 preferably is secured to the outer surface 60*a* of the vessel 60 with the nozzles 50 extending from the manifold 48, through the wall of the vessel 60 thereinto vapor chamber 62 for discharging preheating water into the vapor chamber 62 of the vapor generator vessel V. The vapor generator vessel V may include an impingement or demister screen plate 64 secured to the vessel 60 by angled braces 66, 68, 70 and brackets 72 and 74. The impingement plate 64 provides a demisting function whereby any water droplets which hit the plate 64 due to the high pressure combustion gases contact with the water 75 and/or water from the nozzles 50 within the vapor generator vessel are directed downward to be vaporized by the hot combustion gases, so as to substantially eliminate the carrying of entrained water droplets through outlet 76 and into downstream flowline 78 and formation 10 as discussed more fully hereinbelow.

The vapor generator vessel V further includes baffles 80, 82 each having a plurality of apertures or perforations 80*a*, 82*a*, respectively. The baffles 80, 82 help to prevent the fluid or water 75 within the vapor generator vessel V from being violently displaced in response to the high pressure combustion gases coming from the high pressure combustion chamber 30. A chemical inlet flange 84 is mounted with the lower end of the vessel 60 for connection with a suitable valve or the like (not shown) for injecting chemicals into the water 75 from flowline 86 (FIG. 2). Usually suitable corrosion-preventing chemicals are injected through the flange 84 to protect the vapor generator vessel V and its component parts. Furthermore, when desired, known chemical additivies may be injected for mixture with the steam and combustion gases to improve the injection into the subterranean formation 10 and to increase the recovery of liquifiable minerals therefrom. Such chemical additives are known to those having ordinary skill in the art and accordingly are not discussed herein. A safety relief valve 88 is provided to relieve pressure in the vapor generator vessel V should the pressure become too high and unsafe. Furthermore, an analyzer inlet flange 90 is provided for mounting a suitable valve or the like (not shown) for drawing off fluids from the vapor chamber 62 for checking the composition of the flow stream discharged from the vapor generator vessel V.

It will be appreciated that the high pressure combustion chamber 30 of the directing means D and the vapor generator vessel V are designed to be used in order to provide a high pressure stream of water vapor and combustion gases in the super heat range for utilization within the formation 10. The operation in the super heat range demists the output gases of the vapor generator vessel V to eliminate the entrained droplets which cause corrosion of the well tubing. A blow down outlet or drain valve 92 is provided at the bottom of the vapor generator vessel V. As steam is produced within the vapor generator vessel V, the solids and salts, such as sodium, calcium, magnesium, chlorides and carbonates, which entered with the water being injected thereinto the chamber 62, become concentrated and form a sludge. Thus, in order to keep scale from forming within the vapor generator vessel V, a small portion of the water is allowed to drain out through the drain valve 92. Water can also be injected into the vessel V by injector 54 in addition to the nozzle 50, as well as through the bottom or lower portion of the vessel and in particular through the drain valve 92, if desired.

The apparatus A of the present invention further includes injection means I with the vapor generator vessel V for injecting high quality steam into the high pressure stream of water vapor and combustion gases formed within the vapor generator vessel V, to increase the steam-to-combustion gas ratio of the discharge stream produced with the vapor generator vessel V. The injection means I includes a steam boiler 94 capable of generating at least substantially eighty percent quality steam. The steam boiler 94 may be mobile and mounted on a suitable trailer, such as trailer 96, having a suitable boiler control unit 98 mounted thereon. The steam boiler 94 is preferably adapted to receive suitable water and fuel supplies from supply lines 100, 102, respectively, for producing the substantially eighty percent quality steam. Preferably, suitable connection means 104 with steam boiler 94 and the vapor generator vessel V permits the flow of the substantially eighty percent steam from the steam boiler 94 to the vapor generator vessel V in the direction of arrow 105. The connection means 104 may include a suitable flowline, in the direction of arrow 105, 104*a* for appropriately connecting the boiler 94 with the vessel 60. Preferably, the flowline 104*a* has a suitable flange 104*b* (FIG. 1) formed adjacent the end 104*c* for connection with the vapor generator vessel V. Flange 104*b* is adapted to be mounted with a compatible flange 60*c* formed adjacent the top of the vessel 60.

Preferably, a suitable steam injector 106 extends from the flange 60*c* and is mounted with the vapor generator vessel V, with the steam injector 106 extending into the vapor chamber 62 formed within the vessel 60. The steam injector 106 preferably includes an injector tube 107 and dispersion means 108. The injector tube 107 has the dispersion means 108 (as best seen in FIG. 3) affixed to the lower end 107*a* of the injector tube 107. Preferably, the dispersing means 108 disperses the substantially eighty percent quality steam by injecting it into the vapor chamber 62 of the vapor generator vessel V. The dispersing means 108 of the injection means I includes a flow deflector 109. Preferably, the injector tube 107 is of a substantially tubular configuration having an intake end 107*b* and a discharge, lower end 107*a*, with the injector tube 107 being mounted within the vapor generator vessel V adjacent intake end 107*b*.

The flow deflector 109 is preferably of a substantially conical configuration having a generally conical surface 109*a* formed having an orifice 109*b* adjacent the pointed, uppermost portion (FIG. 3). The conical surface 109*a* directs the high quality steam from the injector tube 107 into the vapor chamber 62 through slots 109*c* formed in the flow deflector 109, in the directions of arrows 120, 122, while some of the high quality steam flows through the orifice 109*b* in the direction of arrow 124 into the vapor chamber 62. The flow detector 109 is mounted within the injector tube 107 adjacent the discharge end 107*a* and also includes generally concave side portions 109*d*. As such, the substantially eighty percent quality steam is thus injected by the injection means I thereinto the vapor chamber 62 within the vapor generator vessel V.

The high quality steam then mixes with the steam and combustion gases produced within the vapor generator vessel V by the hot combustion gases from the high pressure combustion chamber 30 reacting with the water 75 within the high pressure generator vessel V, forming steam therein. It will be appreciated, as best seen in FIG. 2, that the water level within the vapor generator vessel V is determined by the fluid level controller 56, and upon an indication of an unsatisfactory water level, a suitable signal is sent through control conduit 58 to actuate control valve 52 to permit appropriate quantities of water to flow through flowline 42*b* thereinto flowline 54 for making up any additional sums of water 75 necessary to keep the proper level within the vapor generator vessel V. Furthermore, temperature reduction controller 110 in outlet flowline 78 measures the temperature of fluids in flowline 78 and adjusts the valve 44 by connection through control line 111 to maintain a preset temperature in flowline 78 by regulating the amount of water to be discharged through manifold 48 and nozzles 50. Thus, a proper water level is maintained within the vapor chamber 62. As such, the substantially eighty percent quality steam mixes with the combustion gases and steam generated within the vapor generator vessel V to result in a discharge stream wherein a steam-to-combustion gas ratio of substantially 0.2 to 1.2 barrels of steam (as condensed cold water equivalent) per thousand standard cubic feet of combustion gas is achieved.

As a consequence, it is preferred that the flowline 78 communicates with flowline 112 of the flowing means F. The flowing means F is with the vapor generator vessel V for flowing the high pressure discharge stream from the vapor generator vessel V through flowlines 78, 112 into the subterranean formation 10 for enhanced recovery of the heavy viscous petroleum from the subterranean formation 10. It should be understood that the discharge stream, preferably is a mixture of steam and combustion gases which are heated to about 100° or more above the dew point of the mixture (100° Fahrenheit of super heat) for injecting into the subterranean formation 10. As such, such discharge stream containing steam and combustion gases may be superheated at substantially 250–1500 psi gauge pressure at substantially 450°–750° Fahrenheit. However, other pressures, temperatures and degress of superheat of the stream may alternatively be used with the apparatus A of the present invention.

Alternatively, the high (80-90%) quality steam from the steam boiler 94 may be directed from flowline **104*d* (shown schematically in dotted lines in FIG. 2) and injected directly into flowline 112, if such is desired not to be injected by injection means I into the vapor generator vessel V. In such an instance, a reduced amount of combustion gases and steam is discharged from the vapor generator vessel V which is thereafter mixed with the high quality steam for subsequent injection into the subterranean formation 10. The high quality steam thus increases the steam to combustion gas ratio of the stream injected into the subterranean formation 10**.

Thus, in operation, high quality steam is injected by the injecting means I into the vapor generator vessel V where it mixes with steam and combustion gases produced by the interaction of the high pressure combustion gases from the high pressure combustion chamber 30 acting upon the water 75 within the vapor generator vessel V. The steam high pressure combustion gas mixture mixes with the high quality steam and is discharged from the vapor generator vessel V through flowline 78 into the flowing means F, whereinafter the stream is discharged into the wellhead 26, through the tubing 22 and thereinto the formation 10 for recovering heavy viscous petroleum from the subterranean formation 10.

The foregoing disclosure and description of the invention are illustrative and explanatory thereof, and various changes in the size, shape and materials, as well as in the details of the illustrated construction may be made without departing from the spirit of the invention.

We claim:

1. In a method of producing a high pressure thermal vapor stream of water vapor and combustion gases for injection into a subterranean formation for recovering heavy viscous petroleum, the improvement comprising the steps of:

directing high pressure combustion gases into a partially water-filled vapor generator vessel for producing therein a high pressure stream of water vapor and combustion gases;

injecting high quality steam into the high pressure stream of water vapor and combustion gases within the vapor generator vessel to increase the steam-to-combustion gas ratio of the discharge stream producing within the vapor generator vessel; and flowing the high pressure discharge stream from the vapor generator vessel into the subterranean formation for enhanced recovery of heavy viscous petroleum from the subterranean formation.

2. The method of claim 1, wherein said injecting includes the step of:

generating at least a substantially eighty percent quality steam in a steam boiler.

3. The method of claim 1, wherein said flowing includes the high pressure discharge stream having a steam-to-combustion gas ratio between substantially 0.2 to 1.2 barrels of steam (as cold water equivalent) per thousand standard cubic feet of combustion gas.

4. The method of claim 3, wherein the discharge stream has a steam and combustion gas mixture containing at least substantially 100° F. superheat.

5. The method of claim 4, wherein the discharge stream from the vapor generator vessel is superheated steam and combustion gases at pressures between substantially 250–1500 pounds per square inch gauge pressure at temperatures between substantially 450°–750° F.

6. The method of claim 1, further including the step of:

preheating the water to be used in the vapor generator vessel prior to introduction thereinto.

7. The method of claim 6, wherein said directing includes the step of:

producing the high pressure combustion gases within a high pressure combustion chamber.

8. The method of claim 7, wherein said preheating includes the step of:

flowing the water through a water jacket substantially surrounding the high pressure combustion chamber for preheating the water and cooling the combustion chamber.

9. A method of producing a high pressure thermal vapor stream of water vapor in combustion gases for injection into a subterranean formation, for the recovery of heavy viscous petroleum, the improvement comprising the steps of:

directing high pressure combustion gases into a partially water filled vapor generator vessel for producing therein a high pressure stream of water vapor and combustion gases to be discharged therefrom in a discharge stream;

injecting high quality steam into the discharge stream to increase the steam-to-combustion gas ratio of the discharge stream; and flowing the high pressure discharge stream into the subterranean formation for enhanced recovery of heavy viscous petroleum from the subterranean formation.

10. The method of claim 9, wherein said injecting includes the step of:

generating at least a substantially eighty percent quality steam in a steam boiler.

11. The method of claim 9, further including the step of:

preheating the water to be used in the vapor generator vessel prior to introduction thereinto.

12. The method of claim 11, wherein said directing includes the step of:

producing the high pressure combustion gases within a high pressure combustion chamber.

13. The method of claim 12, wherein said preheating includes the step of:

flowing the water through a water jacket substantially surrounding the high pressure combustion chamber for preheating the water and cooling the combustion chamber.

14. An apparatus for producing a high pressure thermal vapor stream of water vapor and combustion gases for recovering heavy viscous petroleum from a subterranean formation, comprising:

a vapor generator vessel, with vapor generator vessel being partially filled with water;

directing means within said vapor generator vessel for directing high pressure combustion gases into said vapor generator vessel for producing a high pressure stream of water vapor and combustion gases in said vapor generator vessel;

injection means within said vapor generator vessel for injecting high quality steam into said high pressure stream of water vapor and combustion gases within said vapor generator vessel to increase the steam-to-combustion gas ratio of a discharge stream produced with said vapor generator vessel; and, flowing means in connection with said vapor generator vessel for flowing said high pressure discharge stream from said vapor generator vessel into the subterranean formation for enhanced recovery of heavy viscous petroleum from the subterranean formation.

15. The apparatus of claim 14, wherein said directing means includes:

a high pressure combustion chamber in connection with said vapor generator vessel for producing high pressure combustion gases.

16. The apparatus of claim 15, further including:

preheating means in connection with said combustion chamber for preheating the water to be used with said vapor generator vessel prior to introduction thereinto.

17. The apparatus of claim 16, wherein:

said preheating means includes a water jacket formed about said combustion chamber for preheating the water to be used with said vapor generating vessel and for cooling said combustion chamber.

18. The apparatus of claim 14, wherein said injection means includes:

a steam boiler capable of generating at least a substantially eighty percent quality steam; and, connection means with said steam boiler and said vapor generating vessel to permit the flow of said substantially eighty percent steam from said steam boiler to said vapor generating vessel.

19. The apparatus of claim 14, wherein said injection means further includes:

a steam injector mounted within said vapor generating vessel, said vapor generating vessel being formed having a vapor chamber therein, said steam injector extending into a vapor chamber formed therein.

20. The apparatus of claim 19, further including:

dispersing means in connection with said steam injector for dispersing said substantially eighty percent quality steam injected into said vapor chamber for said vapor generator vessel.

21. The apparatus of claim 20, wherein:

said dispersing means includes an injector tube and a flow deflector;

said injector tube being of a substantially tubular configuration and having intake and discharge ends thereof;

said injector tube mounted with said vapor generator vessel adjacent said intake end; and, said flow deflector being of a substantially conical configuration mounted within said injector tube adjacent said discharge end.

22. The apparatus of claim 14, wherein said discharge stream has a steam-to-combustion gas ratio between substantially 0.2 to 1.2 barrels of steam (as cold water equivalent) per thousand standard cubic feet of combustion gas.

23. The apparatus of claim 22, wherein said discharge stream of steam and combustion gases has at least substantially 100° F. superheat.

24. The apparatus of claim 23, wherein said discharge stream is superheated steam at pressures between substantially 250–1500 pounds per square inch gauge pressure at temperatures between substantially 450° F.–750° F.

* * * * *